United States Patent [19]

Ueno et al.

[11] Patent Number: 4,779,531

[45] Date of Patent: Oct. 25, 1988

[54] HAND OPERATED PAD PRINTING MACHINE

[75] Inventors: Yoshitake Ueno; Masaya Fujimoto; Tadahiko Kanatani, all of Sakaishi, Japan

[73] Assignee: Teihi Kogyo Kabushiki Kaisha, Japan

[21] Appl. No.: 85,016

[22] Filed: Aug. 13, 1987

[30] Foreign Application Priority Data

Jan. 29, 1987 [JP] Japan ..... 62-12641[U]
Jan. 29, 1987 [JP] Japan ..... 62-12642[U]

[51] Int. Cl.[4] ..... B41F 17/00
[52] U.S. Cl. ..... 101/163; 101/169
[58] Field of Search ..... 101/163, 150, 167, 169, 101/41, 44

[56] References Cited

U.S. PATENT DOCUMENTS 3,188,951 6/1965 Hollerith ..... 101/382 MV
4,060,031 11/1977 Philipp ..... 101/163
4,314,504 2/1982 Combeau ..... 101/163 X
4,453,468 6/1984 Shenoha ..... 101/382 MV

FOREIGN PATENT DOCUMENTS 3506297 8/1986 Fed. Rep. of Germany ..... 101/163
2408464 7/1979 France ..... 101/163
1143617 3/1985 U.S.S.R. ..... 101/163

OTHER PUBLICATIONS

Taihei Industries Co., Ltd, Model T-5D Pad Printing Machine, 1/86; Advertising Literature.
S. Koch Proudcts, Contact Printer, Advertising Literature, no date.

*Primary Examiner*—Clifford D. Crowder
*Attorney, Agent, or Firm*—Barnes & Thornburg

[57] ABSTRACT

A hand-operable pad-type printing machine capable of one hand operation, thereby enabling the operator to handle the printing article by the other hand. In addition, the machine secures the printing precision which would be difficult to achieve under hand-operated pad-type printing machine.

19 Claims, 8 Drawing Sheets

1
2
2a
2b
2c
2d
3
4
4a
4b
4c
5
6
7
8
9
9a
9b
9c
10
11
12
13
14
15
16
17
18
19
20
20a
20b
20c
21
22
23
24
25
25a
25b
25c
30
51
52
53
54
55
56
A
B
X
a
b
I
II
III
IV
V
VI

HAND OPERATED PAD PRINTING MACHINE

BACKGROUND OF THE INVENTION

1. Field of the Invention

The present invention relates to a printing machine, and more particularly to a hand-operable pad-type printing machine adapted for printing designs or lettering on a relatively small amount of articles.

2. Description of Prior Art

The pad-press type printing machines are well known and widely used in printing designs or lettering on articles. This type of printing machine is provided with a pad for transferring ink from a printing surface to an article. In addition an inking plate and doctor blade are provided. For mass printing use the pad, the inking plate, and the doctor blade are automatically operated by means of an electric motor and a pneumatic cylinder.

For small printing use a hand-operable type is also known and used. This type of machine is provided with (1) a driving section whereby either of a pad or a carrier on which the printing surface and article are mounted is horizontally moved so as to enable the pad to locate above the printing surface and article, and (2) a press section whereby the pad is pressed to the printing surface and the article. The application of ink to the printing surface and the removal of superfluous ink therefrom are manually carried out.

There is another pad-type printing machine which is provided with a lever whereby the pad is circularly moved, in association with which the carrier holding the printing surface and article are reciprocally moved in a plane so that the pad and the printing surface are alternately pressed to the article. The application of ink to the printing surface and the removal of a superfluous ink are mechanically operated in association with the movement of the carrier.

The first-mentioned hand-operated pad-type printing machine is disadvantageous in that the operator must use his both hands to operate the driving section and the press section, and that the application of ink to the printing surface and the removal of superfluous ink must be also carried out by hand. This is labor- and time-consuming, and reflects in the cost.

The last-mentioned printing machine may have an increased efficiency because the operation of a single lever effects all the working steps, but the printing precision is sacrificed because of the circular movement of the pad which is likely to cause misalignment between the printing surface and the pad.

OBJECTS AND SUMMARY OF THE INVENTION

The present invention aims at solving the problems pointed out with respect to the known hand-operable pad-type printing machines, and has for its object to provide a pad-type printing machine operable by a single hand without trading off the printing precision.

Other objects and advantages of the present invention will become more apparent from the following detailed description, when taken in conjunction with the accompaning drawings which show, for the purpose of illustration only, one embodiment in accordance with the present invention.

According to the present invention there is provided a hand-operable pad-type printing machine, which comprises;

a body structure;

an ink tray provided in a lower section of the body structure, the ink tray accommodating a printing plate;

a slider unit reciprocally movable in an upper section of the body structure;

a handle pivotally connected to the slider unit at one end thereof, thereby enabling the slider unit to move horizontally;

a pad unit having a pad for transferring inked patterns from the printing plate to the article, the pad unit carried on the slider unit so as to move horizontally in accordance with the movement of the slider unit, wherein the pad unit has a point at which it is engaged with the handle, thereby enabling the pad unit to move vertically when the handle is swung about the pivotal point to the slider unit;

an ink scraper and doctor blade unit carried on the slider unit so as to move horizontally in accordance with the movement of the slider unit, wherein the ink scraper and doctor blade are reciprocally moved in the ink tray;

a first cam mechanism for moving the ink scraper on coming in a state in which it is submerged in the ink in the ink tray so as to cover the printing plate with ink, and on going back in a state in which it is kept out of contact with the printing plate; and a second cam mechanism for moving the doctor blade on coming in a state in which it is kept out of contact with the printing plate, and on going back in a state in which it is submerged in the ink so as to wipe superfluous ink on the printing plate.

DETAILED DESCRIPTION OF THE PREFERRED EMBODIMENT

Figure 1:
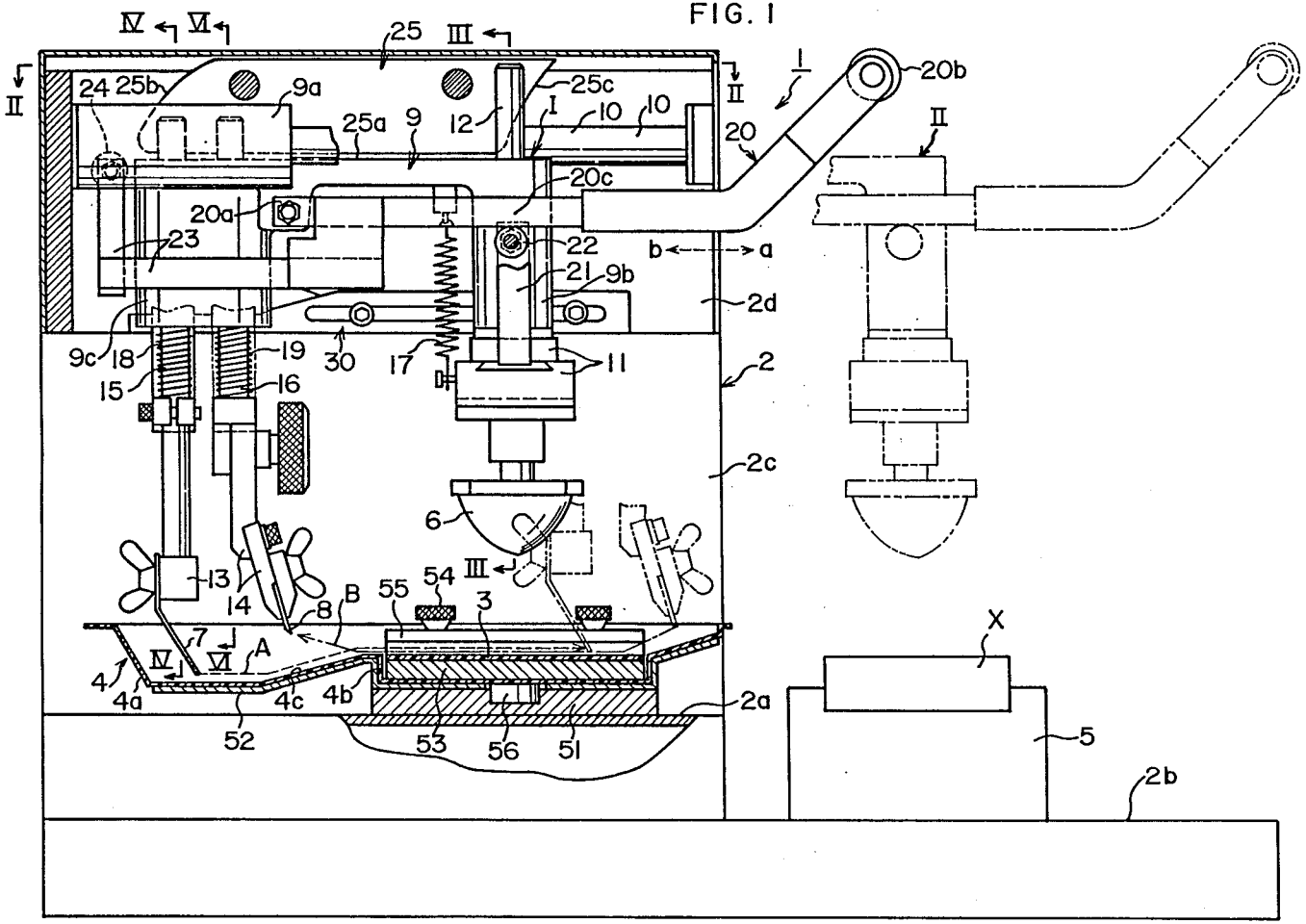
FIG. 1 is a front view showing a printing machine embodying the present invention.
Figure 2:
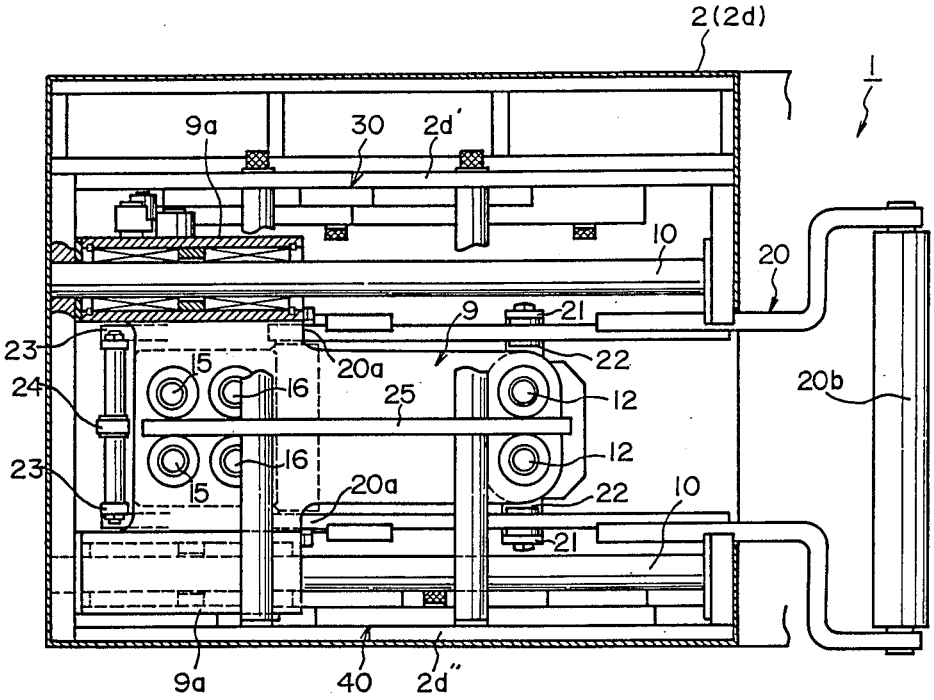
FIG. 2 is a cross-sectional plan view taken along the line II—II in FIG. 1.
Figure 3:
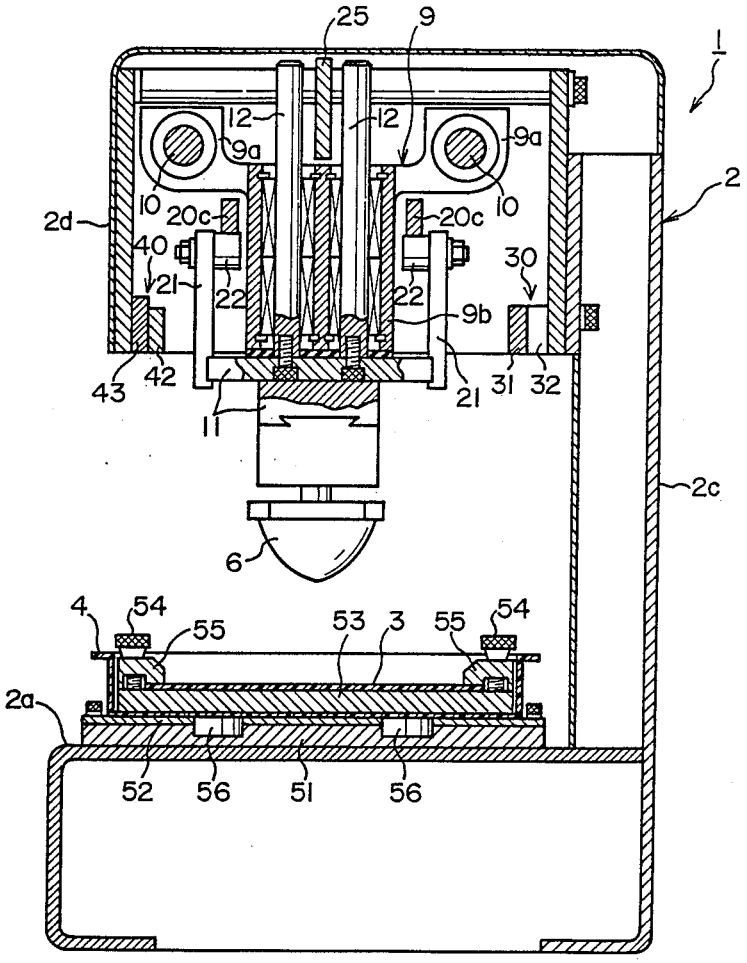
FIG. 3 is a vertical cross-section taken along the line III—III in FIG. 1.

Referring to FIGS. 1 to 3 there is provided a printing machine 1 which includes a body structure 2 (hereinafter referred to as the body). The body 2 includes a raised floor 2*a*, a vertical wall 2*c* and a ceiling space 2*d*.

An ink tray 4 is placed on the raised floor 2*a*, the ink tray 4 accommodating a printing plate 3. The body 2 has an extended portion 2*b* on which a supporter 5 is placed for holding a printing article X. The article in this specification includes all objects on which designs or lettering are printed whether it may be flat or cubic. The body 2 is provided with a slider unit 9 in the ceiling space 2*d* on which an ink-transfer pad 6, an ink scraper 7 and a doctor blade 8 are carried.

The slider unit 9 includes bearing sections 9*a* at opposite sides which are carried on guide bars 10 horizontally provided in the ceiling space 2*d*. Under this arrangement the slider unit 9 reciprocates between the positions I and II as shown by the arrows (*a*) and (*b*). The slider unit 9 is provided with a first guide member 9*b* extended downward, the guide member 9*b* having a pair of bars 12 slidably passing therethrough. The bars 12 supports the pad 6 through a first intermediate member 11. The slider unit 9 is additionally provided with a second guide member 9*c* which have two pairs of bars 15 and 16 slidably inserted therethrough, so as to support the ink scraper 7 and the doctor blade 8, respectively; that is, the supporting bar 15 is fixed to the ink scraper 7 through a second intermediate member 13, and the supporting bar 16 is fixed to the doctor blade 8 through a third intermediate member 14. The pad 6 is upwardly biased by means of a spring 17; normally it is maintained at the height shown in FIG. 1, whereas the ink scraper 7 and doctor blade 8 are downwardly biased by means of springs 18 and 19. The ink scraper 7 and doctor blade 8 are allowed to move between an upper limit and a lower limit, which are defined by a first and a second cam mechanisms 30 and 40. The operation of these cam mechanisms will be described hereinafter.

As the slider unit 9 reciprocates, the pad 6, the ink scraper 7 and the doctor blade 8 reciprocate between the positions I and II as shown in FIG. 1. wherein the pad 6 is above the printing plate 3 at the position I and is above the printing article X at the position II. The ink scraper 7 and the doctor blade 8 reciprocate within the ink tray 4.

The slider unit 9 is moved by a handle 20, which comprises a pair of levers pivotally connected to the slider unit 9 at one ends 20*a*, and a grip 20*b* which projects outside through the ceiling space 2*d*. Each lever has its middle portion 20*c* kept in contact with a roller 22 carried on a bracket.

It is essential for the pad 6 to descend only at the positions I and II; in order to secure it there are a roller 24 provided on an extension 23 of the handle 20, and an abutment board 25 fixed in the ceiling space 2*d*. The abutment board 25 has a bottom 25*a* and sloped sides 25*b* and 25*c*. If the pad 6 is not at the positions I and II the handle 20 is prevented from moving down with the roller 24 coming into abutment with the bottom 25*a* of the abutment board 25, whereas when it is at the positions I and II the roller 24 is guided along the sloped sides 25*b* and 25*c*, respectively, thereby allowing the handle 20 to lower. The length of the abutment board 25 is equal to the distance between the positions I and II.

As shown in FIGS. 4 to 7 the ceiling space 2*d* has walls 2*d'* and 2*d''* at opposite edges. The first cam mechanism 30 and second cam mechanism 40 are located inside the walls 2*d'* and 2*d''*, respectively.

Figure 4:
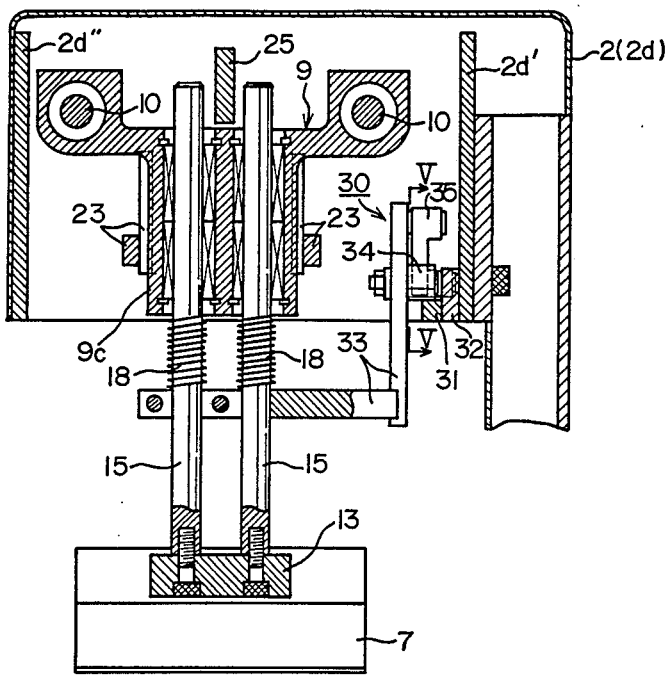
FIG. 4 is a vertical cross-section taken along the line IV—IV in FIG. 1.
Figure 5:
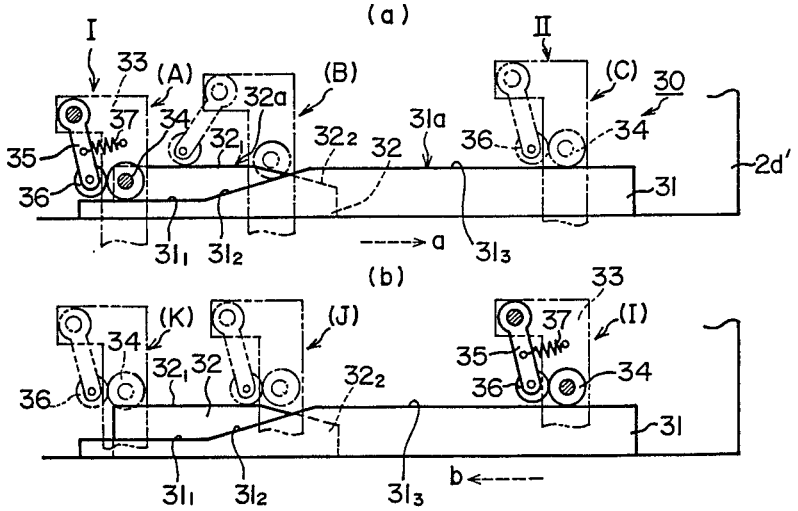
FIGS. 5 (*a*) and (*b*) are diagrammatic views exemplifying the operation of the first cam mechanism viewed in the direction of arrows V—V shown in FIG. 4.

Referring to FIGS. 4 and 5 the first cam mechanism 30 for the ink scraper 7 will be described:

This cam mechanism 30 includes a first planar cam 31 extending to cover the whole distance over which the ink scraper 7 moves, and a second planar cam 32 fixed to a rear portion of the first planar cam 31. wherein the second planar cam 32 terminates short of the length of the first plate 31 so that as shown in FIG. 5 a postion I lacks the second planar cam 32. The top surfaces of these plates 31 and 32 provide cam faces 31*a* and 32*a*, respectively. The first cam face 31*a* includes a lower portion $\mathbf{31}_1$, an ascending slope $\mathbf{31}_2$ and a higher portion $\mathbf{31}_3$. The second cam face 31*b* includes a higher portion $\mathbf{32}_1$ and a descending slope $\mathbf{32}_2$.

The supporting bars 15 of the ink scraper 7 are fixed to a supporting member 33 which has a first follower 34 rolling on the cam face 31*a* and a second follower 36 rolling on the cam face 32*a*, which second follower 36 is carried on an arm 35 pivotally connected to the supporting member 33. The arm 35 is normally biased forward by a spring 37 so that the second follower 36 is placed in abutment with the rear face of the first follower 34 as best shown in FIG. 5(*a*).

Figure 6:
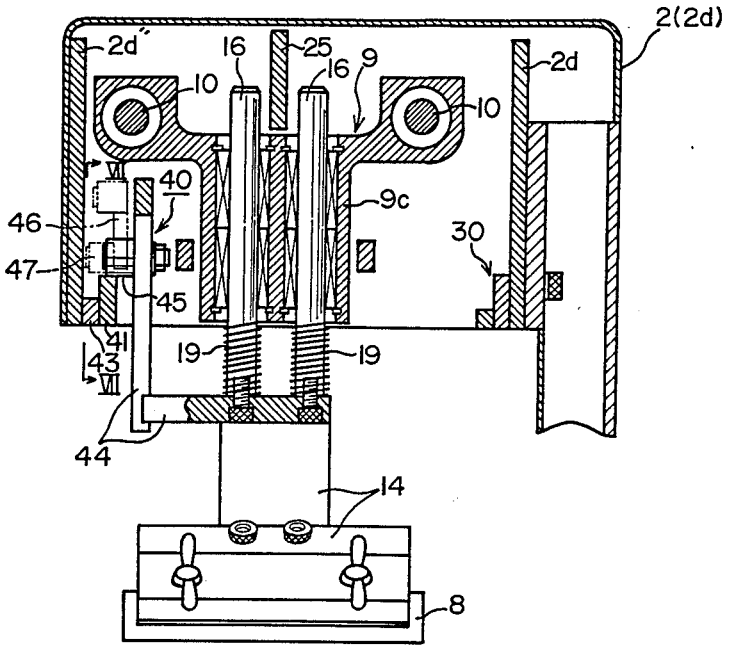
FIG. 6 is a vertical cross-section taken along the line VI—VI in FIG. 1.
Figure 7:
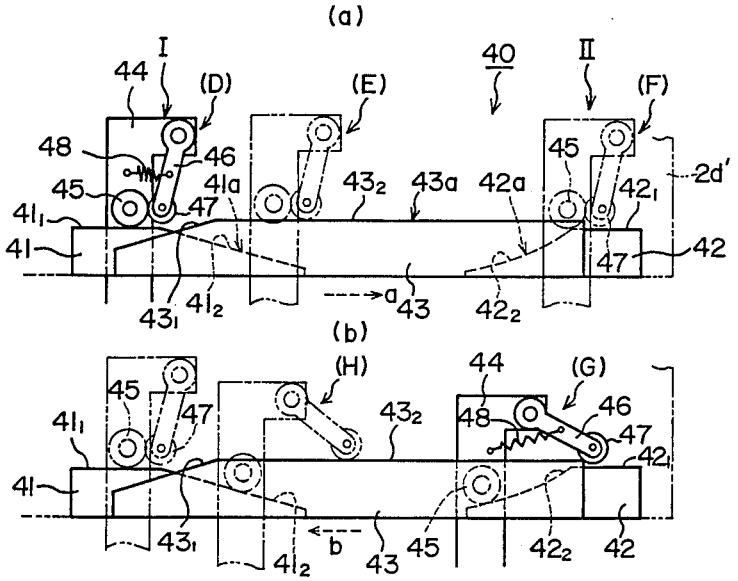
FIGS. 7 (*a*) and (*b*) are diagrammatic views exemplifying the operation of the second cam mechanism viewed in the direction of arrows VI—VI shown in FIG. 6.
Figure 8:
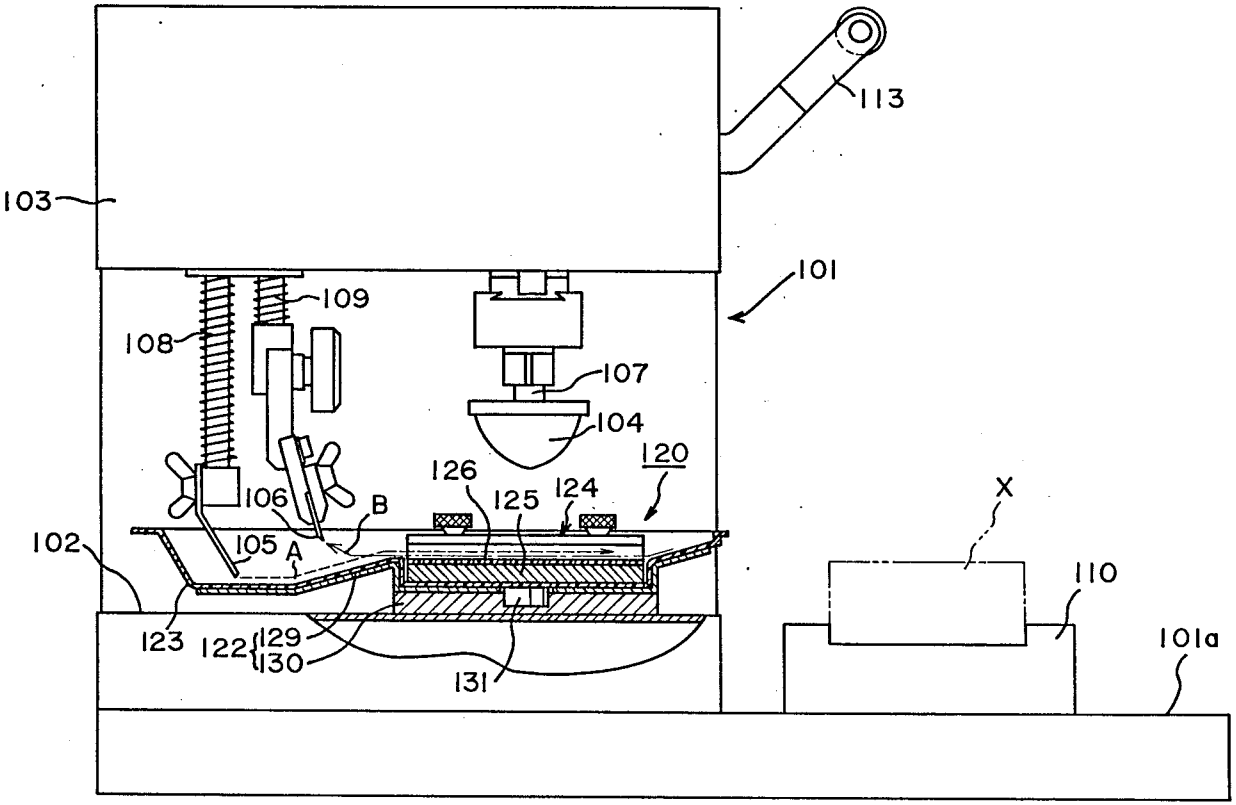
FIG. 8 is a front view particularly showing a printing unit provided in the printing machine.
Figure 9:
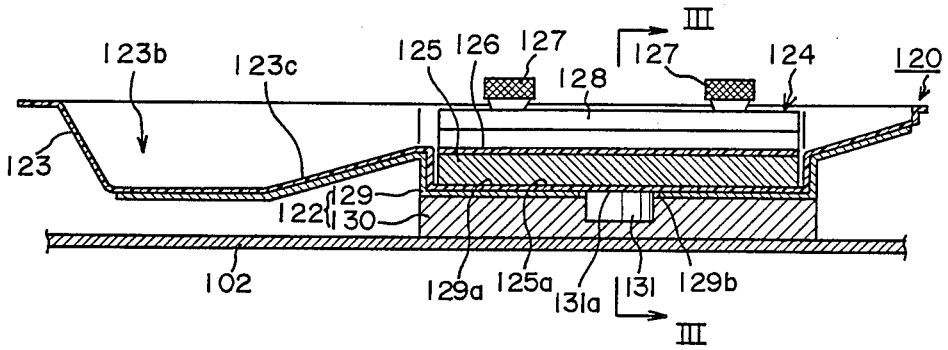
FIG. 9 is a front view on an enlarged scale showing the printing unit of FIG. 8.
Figure 10:
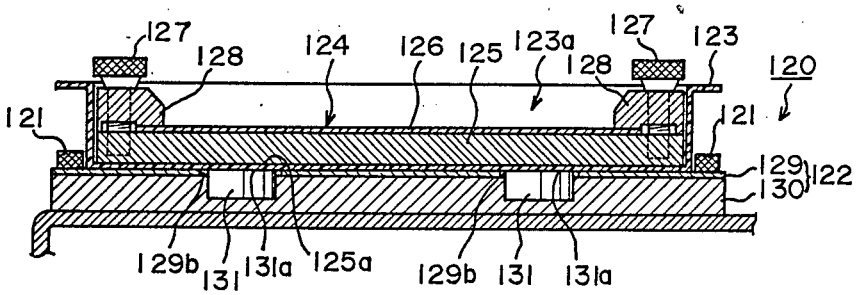
FIG. 10 is a cross-sectional view taken along the line III—III in FIG. 9.

Referring to FIGS. 6 and 7 the second cam mechanism 40 for the doctor blade 8 will be described:

This cam mechanism 40 includes a first planar cam 41, a second planar cam 42 and a third planar cam 43. As best shown in FIG. 7 the third planar cam 43 is fixed to a forward portion of the first planar cam 41 and a backward portion of the second planar cam 42. The top surface of each planar cam 41, 42 and 43 provides a cam face 41*a*, 42*a* and 43*a* at its top, respectively. The cam face 41*a* includes a higher portion $\mathbf{41}_1$ and a descending slope $\mathbf{41}_2$. The cam face 42*a* includes a higher portion $\mathbf{42}_1$ and a descending slope $\mathbf{42}_2$. The cam face 43*a* includes an ascending slope $\mathbf{43}_1$ and a higher portion $\mathbf{43}_2$.

The supporting bars 16 of the doctor blade 8 are fixed to a supporting member 44, on which a first follower 45 is provided for rolling on the cam faces 41*a* and 42*a*. The supporting member 44 is additionally provided with a second follower 47 carried on an arm 46 pivotally connected thereto, the second follower 47 rolling on the cam face 43*a*. The arm 46 is normally biased rearward by a spring 48 so that the second follower 47 is placed in abutment with the front of the first follower 45 as best shown in FIG. 7.

In the illustrated embodiment the ink tray 4 is made of plastic panel, and as shown in FIGS. 1 and 3 it includes a first recess 4*a* for storing ink, and a second recess 4*b* for accommodating the printing plate 3, with a slope portion 4*c* interlocated therebetween for smoothly transferring the ink from the recess 4*a* to the recess 4*b*. The ink tray 4 is placed on a base plate 52 fixed to the raised floor 2*a* through a spacer 51. The printing plate 3 is also made of plastic panel, and secured to a metal block 53 by means of bolts 54 through press means 55. The spacer 51 houses magnets 56 whereby the metal block 53 is attracted to secure the printing plate 3 and the ink scraper 7. In this way the ink tray 4 is secured on the base plate 52.

In operation the handle 20 is rotated in the clockwise direction, with the slider unit 9 being at the position I (FIG. 1), thereby enabling the pad 6 to lower against the spring 17 and come into contact with the printing plate 3 in the ink tray 4. If the printing plate 3 is covered with ink with superfluous ink wiped therefrom, the inked patterns are transferred to the pad 6. Then the handle 20 is rotated in the counter-clockwise direction, that is, in an upward direction, and simultaneously the handle 20 is pulled out so as to enable the slider unit 9 to come to the position II, that is, in the direction of (a) in FIG. 1, where the handle 20 is again rotated in the clockwise direction. In this way the pad 6 is again desended and kept in contact with the article X so that the inked patterns the pad 6 are transferred thereto. When the pad 6 descends to the positions I and II the roller 24 on the extension 23 of the handle 20 is guided along the sloped sides 25*b* and 25*c* of the abutment board 25, thereby ensuring that the pad 6 is properly positioned against the printing plate 3 and the article X. Thus the patterns are printed exactly on desired places on the article.

When the slider unit 9 moves from the position I to the position II the first cam mechanism 30 is operated to cover the printing plate 3 with ink; more specifically as shown in FIG. 5 (*a*) at (A) (the position I) the first follower 34 is located on the lower portion $\mathbf{31}_1$ of the cam face 31*a*. At this stage the ink scraper 7 is submerged in the ink in the first recess 4*a* as shown in FIG. 1. Then the slider unit 9 moves in the direction of arrow (a) in FIG. 1, whereby the followers 34 and 36 are moved together in the direction of arrow (a) in FIG. 5. Immediately after they move the second follower 36 comes into abutment with the rear portion of the second planar cam 32, and rides on the cam face 32*a* of the second planar cam 32 against the spring 37 at (B). The first follower 34 moves to the position (C) (the position II). In accordance with the movement of the first follower 34 the ink scraper 7 moves in the ink tray 4 in the direction of arrow (A) in FIG. 1, and urges the ink in the recess 4*a* onto the printing plate 3 in the recess 4*b*. In this way the printing plate 3 is covered with the ink. At this stage the second cam mechanism 40 is also operated to ensure the following series of operation take place:

At the initial position I, that is, at (D) in FIG. 7 the first follower 45 is located on the higher portion $\mathbf{41}_1$ of the cam face 41*a* (first planar cam 41). However immediately after the followers 45 and 47 move in the direction of arrow (a) the second follower 47 rides on the higher portion 43*a* of the cam face 43*a* via the slope $\mathbf{43}_1$, thereby maintaining its higher position regardless of the descending slope $\mathbf{41}_1$ of the first planar cam 41. Thus the doctor blade 8 is prevented from moving down, and kept at its raised position. However the higher portion $\mathbf{43}_1$ of the third planar cam 43 is slightly higher than the higher portion $\mathbf{41}_1$ of the first planar cam 41 as clearly shown in FIG. 7(*a*), thereby raising the doctor blade 8 by a distance corresponding to the difference between the higher portions $\mathbf{41}_1$ and $\mathbf{43}_1$. At (F) (the position ii) the second follower 47 becomes separated from the third planar cam 43, and the first follower 45 rides onto a boundary between the higher portion $\mathbf{42}_1$ and the slope $\mathbf{42}_1$.

In this way the pad 6 comes into contact with the article X at the position II. Then the pad 6 is caused to ascend and the slider unit 9 is moved in the direction of arrow (b) until it returns to the position I. In accordance with the return of the slider unit 9 the doctor blade 8 wipes superfluous ink on the printing plate 7. More specifically, when the first and second followers 45 and 47 move from the state at (F) in the direction of arrow (b), the second follower 47 comes into abutment with a front of the third planar cam 43, thereby riding on the cam face 43*a* of the third planar cam 43. The first follower 45 moves along the slope 42*a* of the cam face 42*a*. In accordance with the descent of the first follower 45 the doctor blade 8 lowers, and when the first follower 45 descends along the slope 42*a* the dotor blade 8 comes into abutment with the printing plate 3. The doctor blade 8 continues to move on the printing plate 3, thereby wiping superfluous ink from the non-printing area. When the doctor blade 8 moves beyond the printing plate 3 the first follower 45 rides on the higher portion $\mathbf{41}_1$ of the cam face 41*a* from the slope $\mathbf{41}_1$ thereof as shown at (H) in FIG. 7(*b*), thereby causing the doctor blade 8 to rise until it returns to the position I shown in FIG. 1, wherein the second follower 47 again comes into abutment with the front of the first follower 45. In this way the initial starting state is restored. When the slider unit 9 returns to its original position: that is, in the direction of arrow (b) the first cam mechanism 30 is operated as follows:

As shown in (I) and (J) in FIG. 5 (*b*) the first follower 34 is initially on the higher portion $\mathbf{31}_1$ of the cam face 31*a*, and then moves to the descending slope $\mathbf{31}_1$. At this stage the second follower 36 rides on the higher portion $\mathbf{32}_1$ of the cam face 32*a*, thereby ensuring that the ink scraper 7 is maintained at its higher position. When the followers return to the position 1 as shown in (K) in FIG. 7 (*b*) the second follower 36 becomes separated from the second planar cam 32, and the first follower 34 rides on the lower portion $\mathbf{31}_1$ of the first planar cam 31. In this way the initial starting state is restored.

The article X is replaced every time when the printing is finished, and the handle 20 is repeatedly operated from the position 1 to the position II and vice versa.

Referring to FIGS. 8 to 12 the printing unit referred to above will be described in greater detail;

The printing machine has a body 101, which has a floor 102 on which a printing unit 120 is mounted. The printing unit 120 includes a pad 104, an ink scraper 105 and a doctor blade 106. The pad 104 is fixed to a supporting bar 107 slidably supported on the body 101. Likewise the ink scraper 105 and the doctor blade 106 are fixed to supporting bars 108 and 109, respectively, which are also slidably supported on the body 101. The body 101 has an extension 101*a* on which a article unit 110 is provided for containing article X.

These supporting bars 107, 108 and 109 are operated in the afore-mentioned manner.

As shown in FIGS. 9 to 12 the printing unit 120 also includes a base 122 fixed to the floor 102 by means of bolts 121, an ink tray 123 and a printer 124, which includes a metal block 125 of a rectangular shape and a printing plate 126 having ink-carrying hollows (not shown) on its surface. The printing plate 126 is secured to the metal block 125 by means of bolts 127 through press means 128.

Figure 11:
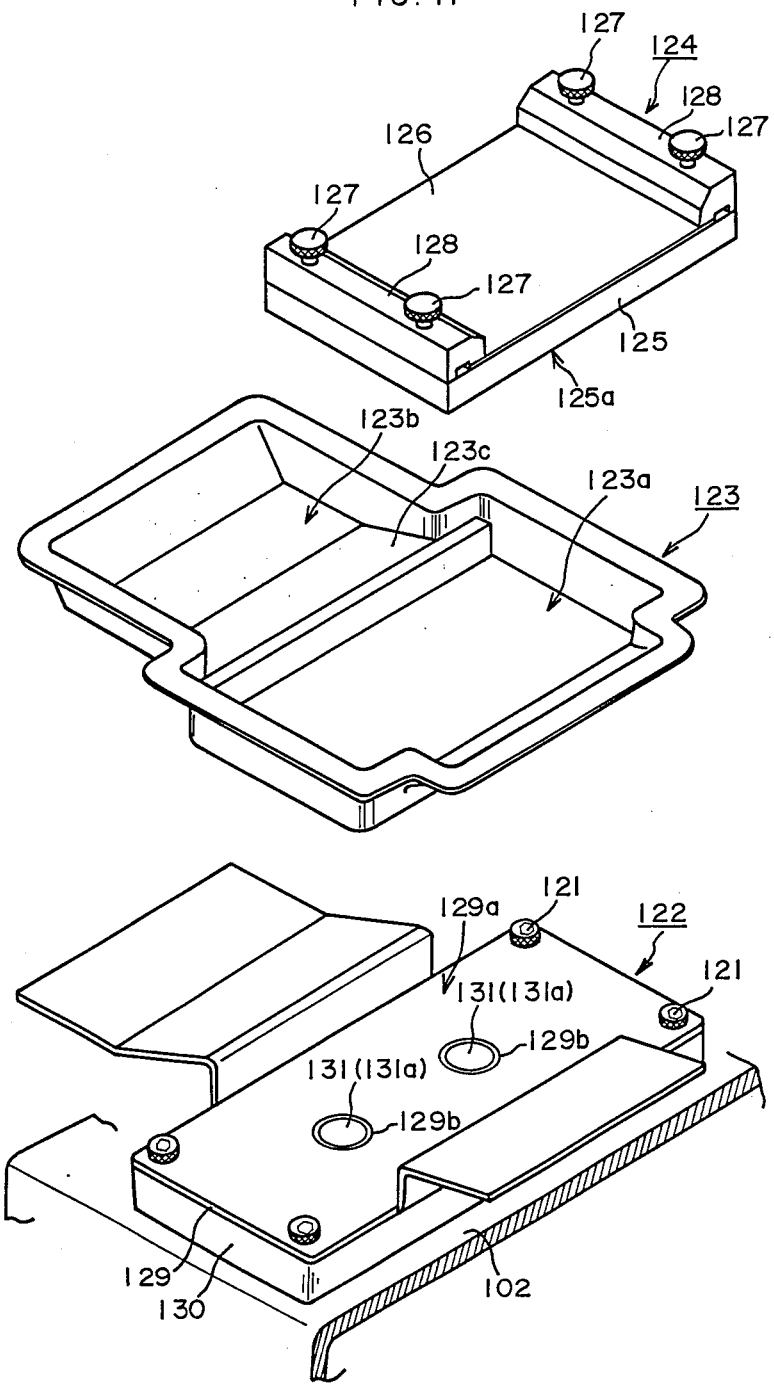
FIG. 11 is an analytical perspective view showing the printing unit.

Particularly referring to FIG. 11 the ink tray 123 is made of plastic by a vacuum forming method, wherein the plastic is not a type liable to chemical corrosion by a solvent present in the ink. As described above the ink tray 123 includes a first recess 123*a* for accommodating the printer unit 124, and a second recess 123*b* for storing ink, with an intermediate slope 123*c* interlocated therebetween.

The base 122 includes a spacer 130 and a sheet 129 on which the metal block 125 is placed. The spacer 130 and sheet 129 are jointed to each other by bolts 121. The spacers 130 are provided with two magnets 131 in holes 129*b* in such a manner that the top surfaces 131*a* of the magnets are flush with the top surface 129*a* of the sheet 129, and attracted to the undersurface 125*a* of the metal block 125, thereby securing the union of the metal block 125 and the base 122.

Figure 12:
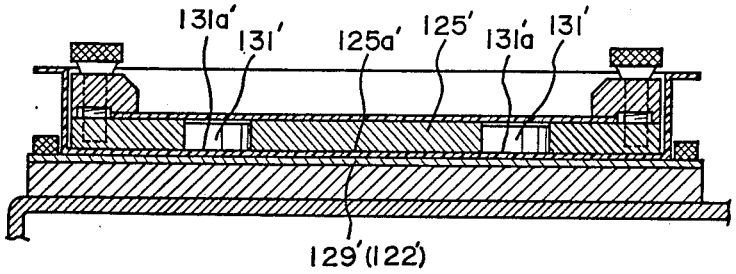
FIG. 12 is a cross-sectional view showing a modified version of the printing unit.

As shown in FIG. 12, magnets 131' can be provided in the undersurface 125*a'* of the metal block 125', wherein the base 122' (the sheet 129') is made of magnetic material. In either case the number of the magnets is not limited to two but can be determined in accordance with the size of the metal block or the magnet per se.

What is claimed is:

1. A hand-operable pad-type printing machine, which comprises:

a body structure;

an ink tray provided in a lower section of the body structure, the ink tray accommodating a printing plate;

a slider unit reciprocally movable in an upper section of the body structure;

a handle mounted for pivotal movement to the slider unit at one end thereof about a pivot point, thereby enabling the slider unit to move horizontally;

a pad unit having a pad for transferring inked patterns from the printing plate to an article, the pad unit being carried on the slider unit so as to move horizontally in accordance with the movement of the slider unit between an inking position adjacent the tray and a printing position adjacent an article to be printed, and the pad unit being mounted for vertical reciprocation on the slider unit, the pad unit being operatively engageable with the handle when in said printing position whereby the pad unit will move only vertically with respect to the slider when the handle is swung about the pivot point to the slider unit;

an ink scraper and doctor blade unit carried on the slider unit so as to move horizontally in accordance with the movement of the slider unit, wherein the ink scraper and doctor blade are reciprocally moved in the ink tray;

a first cam mechanism for moving the ink scraper on coming in a state in which it is submerged in the ink in the ink tray so as to cover the printing plate with ink, and on going back in a state in which it is kept out of contact with the printing plate; and a second cam mechanism for moving the doctor blade on coming in a state in which it is kept out of contact with the printing plate, and on going back in a state in which it is submerged in the ink so as to wipe superfluous ink on the printing plate.

2. A pad-type printing machine according to claim 1, wherein said ink tray forms part of a printing unit provided in a lower section of the body structure, said printing unit including a block detachably fixed to the body structure and a printing plate fixed to the block.

3. A pad-type printing machine according to claim 2, wherein the ink tray is supported directly at a base with said block disposed in said ink tray above the base, and wherein a magnet is provided on at least one of the block and the base with the other of the base and block including magnetic material, whereby the block and the ink tray are joined by magnetic forces which also attract the ink scraper during the scraping operation thereof.

4. A pad-type printing machine according to claim 3, wherein the pad is formed of plastic.

5. A pad-type printing machine according to claim 3, wherein said printing plate and ink tray are formed of plastic.

6. A pad-type printing machine according to claim 1, wherein the pad is movable only in the vertical direction by engagement with the handle when the pad unit is in both the inking and printing positions.

7. A pad-type printing machine according to claim 1, wherein the slide unit is supported for movement along horizontally extending guide means.

8. A pad-type printing machine according to claim 1, wherein the handle is engageable with a support frame for the pad unit at a location spaced horizontally from the pivotal connection of the handle and the slider unit.

9. A pad-type printing machine according to claim 8, wherein the slide unit and the pad unit includes guide means for guiding the pad unit to move only vertically when moved by the handle to the printing position.

10. A pad-type printing machine according to claim 9 further comprising an extension of said handle beyond its pivotal connection with the slide unit and abutment guide board means fixed in an upper area of the body structure, said extension of said handle including an abutment guide means engageable with the abutment guide board means so as to prevent pivotal movement of the handle to move the pad unit downwardly when the slide unit is intermediate the printing and inking positions.

11. A pad-type printing machine according to claim 8, wherein the support frame for the pad unit includes an abutment roller engageable with a downwardly facing portion of the handle.

12. A pad-type printing machine according to claim 10, wherein the support frame for the pad unit includes an abutment roller engageable with a downwardly facing portion of the handle.

13. A pad-type printing machine according to claim 12, wherein the abutment guide member on the extension of said handle includes roller means engageable with guide surfaces of the abutment guide board means.

14. A pad-type printing machine according to claim 10, wherein the abutment guide member on the extension of said handle includes roller means engageable with guide surfaces of the abutment guide board means.

15. A pad-type printing machine according to claim 8, further comprising return spring means continuously biasing the support frame for the pad unit in an upward direction.

16. A pad-type printing machine according to claim 10, further comprising return spring means continuously biasing the support frame for the pad unit in an upward direction.

17. A pad-type printing machine according to claim 13, further comprising return spring means continuously biasing the support frame for the pad unit in an upward direction.

18. A pad-type printing machine according to claim 7, wherein said horizontally extending guide means permit only horizontal movement of the slide unit between the printing and inking positions of the pad unit.

19. A pad-type printing machine according to claim 1, wherein the body structure includes fixed housing structure which surrounds the slide unit from the top and lateral sides.

* * * * *

UNITED STATES PATENT AND TRADEMARK OFFICE

CERTIFICATE OF CORRECTION

PATENT NO. : 4,779,531

DATED : October 25, 1988

INVENTOR(S) : Yoshitake Ueno; Masaya Fujimoto; Tadahiko Kanatani

It is certified that error appears in the above-identified patent and that said Letters Patent is hereby corrected as shown below:

On the Title Page,
Item [73] should read TAIHEI KOGYO KABUSHIKI KAISHA, Japan

Signed and Sealed this

Twenty-seventh Day of June, 1989

*Attest:*

DONALD J. QUIGG

*Attesting Officer*

*Commissioner of Patents and Trademarks*